United States Patent [19]

Schwer

[11] 4,130,748

[45] Dec. 19, 1978

[54] PLUG-TYPE SWITCH

[75] Inventor: Lukas Schwer, Haigerloch, Germany

[73] Assignee: Theben-Werk Zeitautomatik GmbH & Co. KG., Germany

[21] Appl. No.: 778,590

[22] Filed: Mar. 17, 1977

[30] Foreign Application Priority Data

Mar. 17, 1976 [DE] Fed. Rep. of Germany ..... 2611154

[51] Int. Cl.[2] ..... H01H 43/00

[52] U.S. Cl. ..... 200/38 D; 200/38 FB

[58] Field of Search ..... 200/38 FB, 38 D, 38 DA

[56] References Cited

U.S. PATENT DOCUMENTS

| | | | |
|---|---|---|---|
| 3,558,391 | 6/1971 | Banathy et al. | 200/38 D X |
| 3,754,107 | 8/1973 | Balchunas | 200/38 FB X |
| 3,824,418 | 7/1974 | Balchunas | 200/38 FB X |
| 3,925,629 | 12/1975 | Albinger, Jr. | 200/38 FB X |
| 3,997,742 | 12/1976 | Marquis | 200/38 FB |
| 4,012,607 | 3/1977 | Graesslin et al. | 200/38 D |
| 4,029,918 | 6/1977 | Kah, Jr. | 200/38 DA X |

FOREIGN PATENT DOCUMENTS

| | | |
|---|---|---|
| 1894373 | 8/1963 | Fed. Rep. of Germany. |
| 2106224 | 8/1972 | Fed. Rep. of Germany. |
| 1959504 | 9/1973 | Fed. Rep. of Germany. |
| 221708 | 9/1942 | Switzerland. |

*Primary Examiner*—James R. Scott
*Attorney, Agent, or Firm*—McGlew and Tuttle

[57] ABSTRACT

An electric power supply operated switch clock comprises a housing with a synchronous motor in the housing which is adapted to drive a rotatable switch ring for timed rotary movement so as to cause riders positioned at selected one or ones of a plurality of switch rider receiving elements on the ring to engage and actuate a quick-break switchgear in the housing. The construction includes a plug head which is engaged on one end of the housing and a plug socket which is engaged on the other end with a pin bushing block being disposed therebetween. A synchronous motor mounted between the plug head and the plug socket is connected through a timing mechanism disposed around the pin bushing to drive the drive ring which is rotatable over a rib formed in a housing partition wall and on a socket cup which engages through the adjacent end wall. The construction includes a quick-break switch gear located in the housing around the pin bushing in a position to be engaged by one or more riders which are contained in the switch ring. The riders may be positioned adjustably around the circumference of the ring and located at a selected radial distance to engage one or more elements of a switch wheel to effect the desired timed switching.

11 Claims, 5 Drawing Figures

PLUG-TYPE SWITCH

FIELD AND BACKGROUND OF THE INVENTION

This invention relates in general to the construction of switching gear and, in particular, to a new and useful electric power supply operated switch clock of the plug-type having a driving ring with adjustable riders for actuating a switching mechanism.

DESCRITPION OF THE PRIOR ART

The present invention relates particularly to a plug-type switch clock comprising a plug head supporting two contact pins which fit in power-supply socket outlets, a plug socket which is coaxial thereof and includes a pin bushing block and a socket cup, and a timing mechanism accommodated in a housing connected to the plug head and the plug socket and driving a switching mechanism which is adjustable to definite switching times and which, by means of a quick-break switchgear, actuates an electric switch which is mounted in the housing and is connected between one contact pin of the plug head and one pin bushing of the plug socket.

A known plug-type switch clock of this kind includes a housing provided between the plug head fitting in power-supply outlet boxes and the plug cup, which receives wire plugs of electrical appliances to be controlled by the switch clock. The housing is oblong in shape and extends centrically of the common axis of the plug head and has a socket outlet. On the front side above the socket outlet, the housing is provided with a fixed dial with a pointer which is manually adjustable from behind the housing. It accommodates a timing mechanism, an electric switch actuable by the timing mechanism, and the pin bushing block of the socket outlet. The overall size of the housing is approximately that of a double power supply outlet box so that, in practice, the use of such a switch clock may be inconvenient. In addition, for adjustment of the desired switching times, this kind of switch clock must be pulled out of the outlet box in order to gain access to the adjusting element on the back side of the housing.

In another known plug-type switch clock (German Patent No. 1,959,504, the timing mechanism, along with the electrical switching mechanism, is accommodated in a substantially parallelepiped-block-shaped housing, on the back side of which the plug head, with the two contact pins, is mounted by means of a frustoconical intermediate part, and on the front side of which a plurality of concentric control rings with scales are provided by means of which the switching times of the appliance can be adjusted. This device, however, does not comprise a socket outlet. Instead, it is equipped with a connecting cable leading from the electric switch through the housing bottom to the outside and the other end of the cable must be either directly connected to the appliance to be controlled or provided with a plug connection. It is true that with this switch clock, the switching times can be adjusted from the front side without the necessity of pulling the clock out of the outlet box. However, it is disadvantageous that the clock itself is not equipped with a socket outlet, but with a connecting cable which, in most applications, is disturbing and impeding.

SUMMARY OF THE INVENTION

The present invention is directed to a plug-type switch clock on which the desired switching times can be adjusted and read any time from the front side of the housing and wherein the overall dimensions of the clock are reduced to an extent such that it can be used without any difficulties with either two- or multiway outlet boxes.

In accordance with the invention, it is provided that the timing mechanism, which is driven by a synchronous motor, as well as the electric switch and the quick-break switch gear thereof are located in the housing around the pin bushing block, and that the switching mechanism comprises a switch ring which rotatably surrounds a socket cup and is provided with a plurality of receiving elements which are angularly equidistantly spaced from each other and receive switch riders to be plugged therein to actuate the quick-break switch gear.

Aside from the fact that the inventive switch clock can be easily and very simply adjusted to the desired switching times from the front side by means of plug-in switch riders, in a well known manner, and does not require any connecting cable, it has the additional advantage as compared with the prior art switch clocks of the above-mentioned kind that due to its square outer shape complying with the basic-grid system measures of a standard flush socket, it can be used without any difficulties with both single- and multiway sockets, while giving the impression in outer appearance and in an optically appealing manner of a power-supply socket plate or of a flush switch as presently used for lighting purposes. The invention makes it possible for the first time to provide a plug-type switch clock in a size complying with the basic-grid measures of a modern flush socket or of a flush switch. It is equipped with a socket outlet instead of a connecting cable which is necessary for automatic timers of the prior art. The construction permits the adjustment of switching times from the front side by means of elements known per se.

A development of the invention provides that the switch ring comprises a circular shoulder which is integrally formed on the circumference of a substantially cylindrical guide body having one of its ends provided with a toothed rim and its other end provided with a grip surface, and which is provided with plug bores, or the like, for the switch riders. The bores are arranged in pairs having their axes parallel to each other. Due to this design, the switch ring can be advantageously provided at a location which is most suitable for adjustment, while utilizing space which is already available. The device can also be mounted easily with the grip surface which serves for an accurate time adjusting and the plug bores provided in the circular shoulder and receiving the switch riders which are at any time easily accessible and also easy to survey. Another advantage is that a sufficient circumferential length is available permitting adjustment of relatively very small periods of time due to the arrangement of the plug bores for receiving the switch riders in the circular shoulder. It is easily possible to adjust periods in the order of magnitude of 5 minutes.

To obtain a mounting of the switch ring with a minimum of friction and with positive engagement, it is provided, in accordance with a further development of the invention, that one end of the switch rings is guided on the circumference of the socket cup by means of an annular rib extending circularly along the inside of the guide body, and its other end is guided by means of an axial, annular, rib formed on a housing partition provided near the socket cup bottom, and that the switch ring engages a pinion of the timing mechanism extending through the housing partition.

In its axial direction, the switch ring is fixed by the partition of the housing and by a collar of the socket cup. As is usual with conventional socket boxes, the socket cup is detachably screwed to the pin bushing block located behind the partition by means of a central screw which extends through the bottom of the socket cup, so that it is easily replaceable.

Accordingly, it is an object of the invention to provide an improved electric power supply operated switch clock, which includes a housing having interengageable parts and with one end easily connectable through a plug head to an electric power source and the other end provided with a plug socket for connecting an apparatus to be timed, which further includes a rotatable drive ring having a plurality of angularly spaced switch rider receiving elements which may be engaged by one or more riders for the purpose of contacting and actuating switch gear in timed relationship to the rotation of the ring.

A further object of the invention is to provide a plug-type switch clock which is simple in design, rugged in construction, and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there is illustrated a preferred embodiment of the invention.

DESCRIPTION OF THE PREFERRED EMBODIMENT

Figures 1, 2:
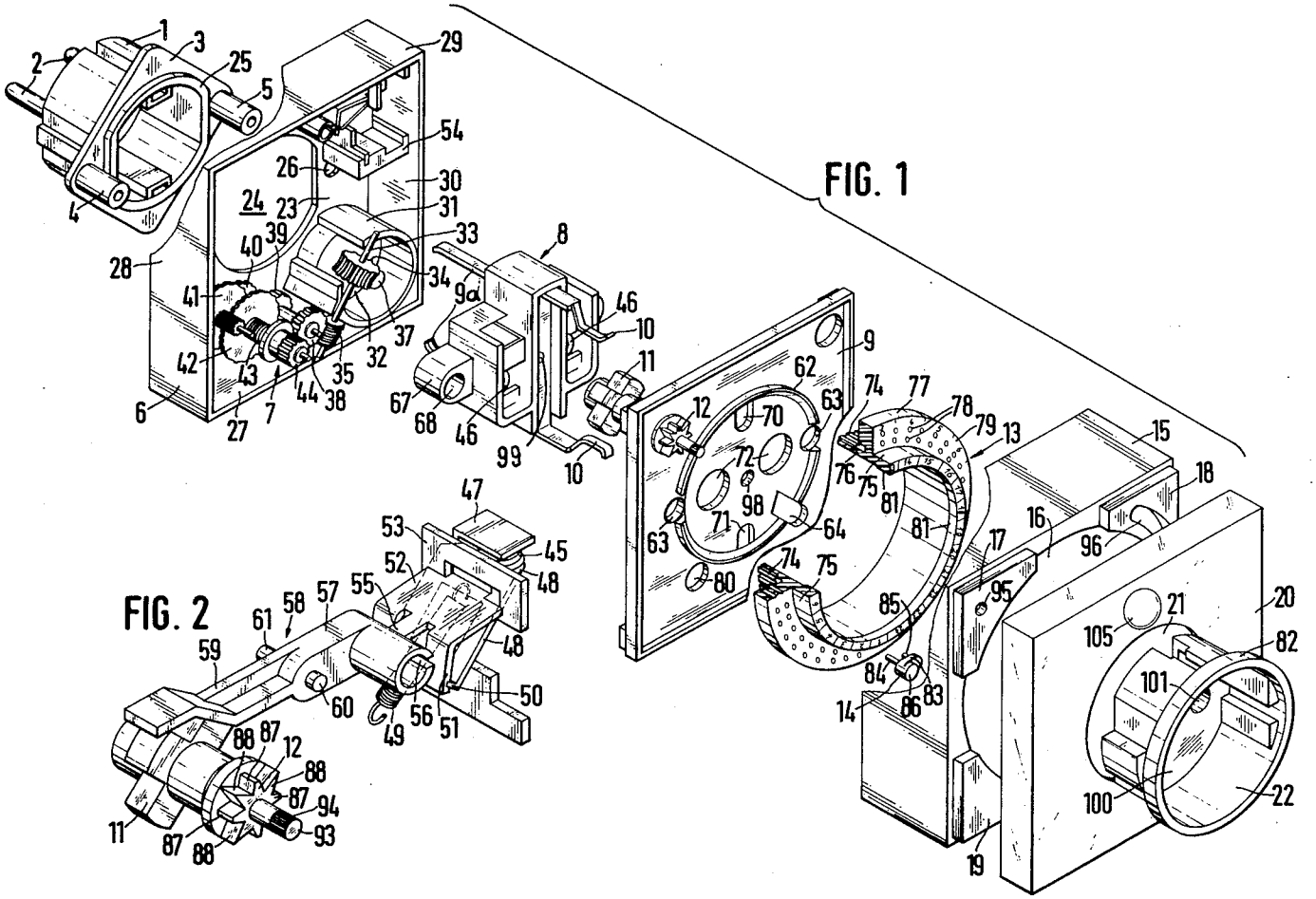
FIG. 1 is an exploded perspective view of the component parts and assemblies of a plug-type switch clock constructed in accordance with the invention.
FIG. 2 is a perspective view of the switch actuating mechanism.
Figure 3:
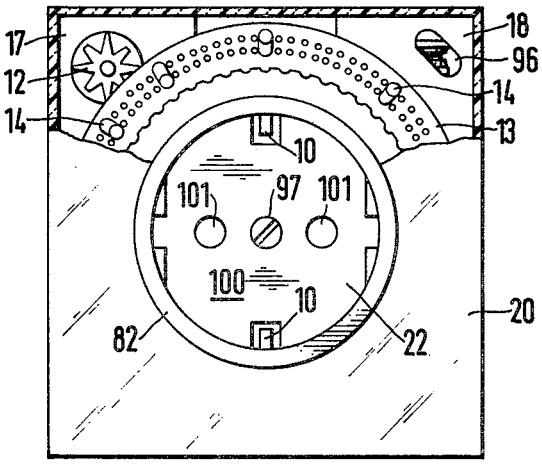
FIG. 3 is a partial sectional and front view of the plug-type switch clock.

Referring to the drawings in particular, the invention embodied therein, comprises an electric power supply operated switch clock which comprises a housing made up of interengageable housing parts which accommodate in a simple and compact manner, various cooperating elements for effecting the timed control of an operation of a device.

As best seen in FIG. 1, the inventive switch clock in the contemplated embodiment comprises the following components, parts and assemblies.

A plug head 1 including two contact pins 2 and a substantially rectangular flange 3 which is equipped with two diametrally oppositely located hollow pins 4 and 5 is provided.

A square lower housing part 6 accommodating a timing mechanism 7 and the switch actuating mechanism 58 shown in FIG. 2, is provided over plughead 1, and a pin bushing block 8 having grounding contact springs 93 and 10 is positioned in the housing part 5.

A partition wall 9 on one corner of which a switch star 11 and a switch wheel 12 are mounted for rotation is disposed over housing part 6 and a switch ring 13, equipped with plug-in switch riders 14 is rotatable in wall 9.

A square upper housing part 15 is engaged over lower housing part 6 and has a circular central opening 16 for receiving switch ring 13, and is provided with frontally secured, substantialy triangular, corner pieces 17, 18 and 19, the fourth corner piece being not visible in the drawing.

A cover 20 of transparent material is lockingly engageable over corner pieces 17, 18 and 19 and provided with a centric, circular opening 21.

A socket cup 22 is finally provided which can be inserted through opening 21 of cover 20.

Lower part 6 of the housing comprises a bottom 23 in which an opening 24 is provided which serves to receive a circular rib 25 of flange 3 of plug head 1 and, in addition, it has two bores 26 through which hollow pins 4 and 5 can be passed. Lower housing part 6 also comprises four walls 27, 28, 29 and 30 which, along with a bottom 23, give the lower housing part a box-like shape with a square base. In the lower, righthand, corner formed by walls 27 and 30, a ring shell 31 integrally formed thereon is provided, in which a synchronous motor 32 serving as a timer is clamp-fitted, and in which the common shaft 33 of a worm wheel 34 and a worm 35 are mounted for rotation. Worm wheel 34 meshes with a worm 37 carried on the shaft of the synchronous motor, while worm 35 of shaft 33 meshes with a worm wheel 38 which, in turn, is connected to a coaxial spur gear 39. Through two further change gears 40 and 41, each comprising a pinion and a wheel, a gear 42 is driven which is operatively connected, through a single-way coupling comprising a helical spring, to a pinion 44. The component parts 33 to 44 just described, along with synchronous motor 32, form together the timing mechanism 7 serving the purpose of driving switch ring 13.

While timing mechanism 7 is accommodated at the bottom of lower part 6 of the housing, the switching mechanism for an electric switch 45, shown separately in FIG. 2 as an assembly, is located at the top of lower part 6 of the housing. Switch 45 establishes or interrupts the electric connection between one of the two plug pins 2 and one of the two pin bushings of bushing block 8.

Switch 45 comprises a fixed switch contact finger 47 located in the upper righthand corner of lower part 6 of the housing, and a toggle lever 48 with a switch contact from which a tension spring 49 is suspended and which rests by its lower, angled, end portion 50 against a recess provided in the vertical leg of an angle lever 52. Both toggle lever 48 and angle lever 52 are pivotally mounted on a substantially U-shaped bracket 53 which is seated in a grooved block 54 formed integrally with housing bottom 23. Angle lever 52 comprises a tongue 55 engaging into a slot 56 of one arm 57 of a two-armed lever 58, the second arm 59 of which is applied against switch star 11. By means of trunnions 60 and 61 integrally formed therewith, two-armed lever 58 is mounted for rocking motion in lower part 6 of the housing, the two trunnions 60 and 61 being received in partition 9 and in housing bottom 23, respectively. Consecutive rotary motions of the four-armed switch star 11 through 45° effect quick opening and closing motions of switch 45. The quick-opening switching mechanism comprises toggle lever 48, angle lever 52 and tension spring 49, which is dimensioned so that each motion, stable closing and opening positions of toggle lever 48 are ensured.

On its front side, partition wall 9 is provided with an annular rib 62 which is interrupted by diametrally opposite bores 63 and by a recess 64. Annular rib 62 serves to guide switch ring 13. On its back side, partition 9 is formed with integral cylindrical ledges 65 (see FIG. 4) which are coaxial of bores 63 and comprise an inner circular shoulder 66. Bores 63 and ledges 65 are arranged so that upon assembling plug head 1, lower part 6 of the housing, pin bushing block 8 and partition 9, these parts are aligned with hollow pins 4 and 5 of plug head 1. Pin bushing block 8 is provided with lateral lugs 67 having bores 68 which are also coaxially coaxially aligned with hollow pins 4 and 5 of plug head 1. Plug head 1, lower part 6 of the housing, pin bushing block 8, and partition 9 are assembled in the positions shown in FIG. 1 and secured to each other by means of screws 69 which are passed from the front side through bores 63 of partition 9 and are screwed into hollow pins 4, 5 of plug head 1. Hollow pins 4 and 5 extend through bores 26 of housing bottom 23 and through bores 68 of lugs 67, so that lugs 67 are clamped between bottom 23 of lower part 6 of the housing and cylindrical ledges 65 of partition 9*a*. As may be learned from FIG. 4, bores 63 extend also beyond circular shoulders 66, so that hollow pins 4, 5 can project into bores 63.

Partition 9 is further provided with U-shaped recesses 70 and 71 which are offset through 90° relative to bores 63 and through which grounding contact springs 10 of pin bushing block 8 can extend. Further bores 72 are provided in partition 9 between bores 63 which are coaxial of pin bushing 46 of bushing block 8 and are provided for receiving two annular extensions 73 of socket cup 22 (FIG. 4).

Switch ring 13 has an annular shoulder 77 which is formed integrally on the periphery of a substantially cylindrical guide body 76 having one end portion provided with a toothed rim 74 and its other end portion with a grip surface 75. Annular shoulder 77 is provided with a plurality of angularly equidistantly spaced plug-in bores 78 which are arranged by pairs having axes parallel to each other and extending in the axial direction of the guide body. The bores 78 are intended for receiving switch riders 14. They are associated with a circular scale 79 provided on annular shoulder 77 and divided so as to indicate 24 hours. In the embodiment shown, the angular distances between the pairs of plug-in bores correspond each to the period of half an hour. The time scale is marked accordingly. In the zone of toothed rim 74, the inside diameter of guide body 76 corresponds to the outside diameter of annular rib 62 of partition 9, so that in the position shown in FIG. 1, the switch ring 13, engaged on partition 9, is centered and rotatably guided by annular rib 62. Outside annular rib 62, partition 9 is provided with another bore 80 through which pinion 44 of the timing mechanism is passed to mesh with toothed rim 74 of switch ring 13.

Figure 4:
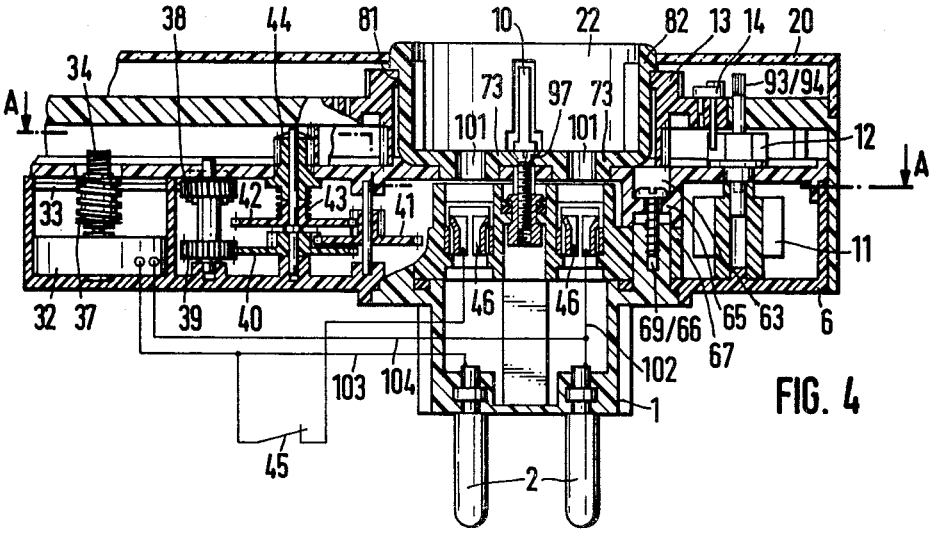
FiG. 4 is a sectional view of the switch clock of FIG. 3, with the timing mechanism displaced into the drawing plane.
Figure 5:
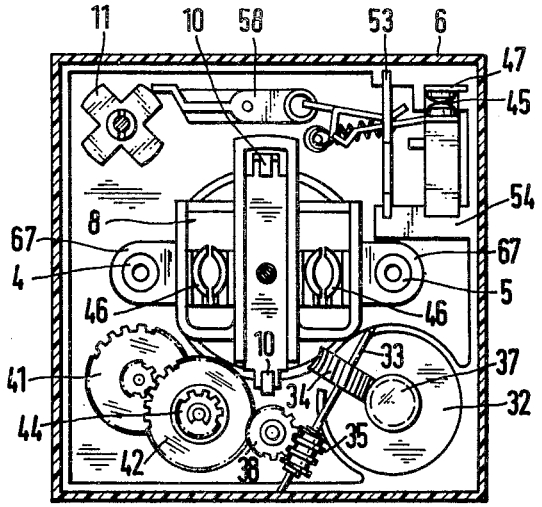
FIG. 5 is a sectional view taken along the line A—A of FIG. 4.

On its front side end portion, guide body 76 of switch ring 13 forms a circular rib 81, the inside diameter of which corresponds to the outside diameter of the substantially cylindrical socket cup 22 so that, as shown in FIG. 4, in addition to annular rib 62 of partition 9, socket cup 22 serves as a guide element for switch ring 13. It may also be learned from the drawing that on its front side end portion, socket cup 22 is provided with a collar 82 which radially engages over the outer front face of circular rib 81 and thus secures switch ring 13 in the axial direction.

Each plug-in rider 14 comprises a rider body 83 and two pins 84 and 85 integrally formed therewith, of which one is longer than the other. While pin 84 is longer than the axial thickness of annular shoulder 77 of switch ring 13, and consequently projects from the backside or underside of shoulder 77 in odfer to engage switch wheel 12 of switch star 11, the length of pin 85 corresponds approximately to the axial thickness of annular shoulder 77 so that pin 85 does not project from the underside of shoulder 77 when rider 14 is plugged in. Otherwise, pins 84 and 85 are disposed and dimensioned so as to fit in the plug-in bores 78 of switch ring 13 arranged in pairs. To be able to discern from the outside of rider 14, the position of the longer pin 84, rider 14 is provided on its top with a stud 86 which is coaxial of pin 84.

It may be learned particularly from FIG. 2 that switch wheel 12 is provided with alternately short and long teeth 87, 88 and that a total of eight teeth are provided, thus four long teeth 88 and four short teeth 87. The operational reason for this design is the fact that the plug-in bores 78 are arranged in switch ring 13 in pairs and that switch rider 14 can be selectively plugged in so as to have the longer pin 84 inserted either in one of the bores along the smaller radius or in one of the bores of the larger radius. In the first case, where rider pin 84 is plugged into a bore of the smaller radius, pin 84 can engage only the long teeth 88 of switch wheel 12, while, if plugged in a bore of the large radius, pin 84 can index also the short teeth 87 of switch wheel 12. This makes it possible to associate the switch rider with either a closing function of switch 45 or an opening function of switch 45.

The upper part 15 of the housing wherein the opening 16 receives annular shoulder 77 of switch ring 13 in the assembled state of the switch clock, as shown in FIG. 4, comprises four lateral walls 89, 90, 91 and 92 which engage snugly over lateral walls 27, 28, 29 and 30 of lower part 6 of the housing (FIG. 4) with the outer dimensions thereof corresponding to the basic grid module of 80 mm. Upper part 15 of the housing is secured to lower part 6 by means of screws or of a locking connection (not shown).

In order to turn switch star 11 manually also to cause switch 45 to respond, switch wheel 12 is provided with a cylindrical pin 93 having a serrated end portion 94 which projects from a bore 95 provided in corner piece 17 of upper part 15 of the housing. To make it possible to ascertain the instantaneous switching position of switch 45 from the outside, a slot 96 is provided in corner piece 18 through which switch 45 is visible.

Socket cup 22 is secured by means of a screw 97 which is screwed through a central bore 98 of the partition 9 into a threaded bushing 99 of pin bushing block 8, the flat head of which is received in a countersink of bottom 100 of socket cup 22. Bottom 100 of socket cup 22 is also provided with two bores 101 which are located coaxially of bushings 46 of pin bushing block 8 and through which the contact pins of a plug can be introduced.

As diagrammatically shown in FIG. 4, one of the two plug pins 2 is electrically directly connected through a wire 102 to one of the two pin bushings 46, while the other (lefthand) of the two plug pins 2 is connected through switch 45 to the other pin bushing 46 of pin bushing block 8. Synchronous motor 32 is connected through wires 103 and 104 to the two plug pins 2.

Cover 20 which is made of a transparent material and whose opening 21 corresponds to the outside diameter of collar 82 of socket cup 22 can be easily engaged with a slight clamping effect over corner pieces 17, 18 and 19 of upper part 15 of the housing, and also easily removed again. Cover 20 protects switch ring 13 and the plugged-in switch riders 14 against undesirable effects from the outside and acts also as an additional dust guard.

For adjusting the desired switching times, it is sufficient to plug switch riders 14 into switch ring 13, in accordance with the indication of scale 79. The respective correct period of time can be adjusted by correspondingly turning switch ring 13 in the forward direction. As soon as plug 1 of the plug-in switch clock is engaged into a power supply socket outlet, synchronous motor 32 starts running and drives switch ring 13 in synchronism with the time, so that ring 13 executes one revolution every 24 hours. Of course, it is easily possible to provide another cyle of switch ring 13 by choosing a corresponding timing mechanism.

It may be easily understood that an appliance to be controlled can be connected to the inventive switch clock simply by engaging the respective plug of the appliance into socket cup 22.

In a modification of the embodiment shown in the drawings, it may be advantageous to extend guide body 76 so as to have its grip surface projecting to the outside, beyond the front surface of cover 20, thereby, making it possible to turn switch ring 13 manually without having to remove the cover. To this end, of course, it would be necessary to provide an opening 21 with a correspondingly larger diameter. It has also been found advantageous to provide the time scale 79 on annular shoulder 77 of switch ring 13 and to equip cover 20 with an optical magnifying lens 105 through which the respective time indicated on switch ring 13 can be far better read.

In the preferred embodiment, the square housing 6/15 has the standard basic grid size of 70mm × 70mm, as is usual with so-called flush switches of modern electrical installations. Other basic grid dimensions of the housing might also be provided, of course. It is further possible to provide a round or oval shape housing instead of the substantially square shape, at least one of the two superficial dimensions, however, should not exceed the standard grid module.

While a specific embodiment of the invention has been shown and described in detail to illustrate the application of the principles of the invention, it will be understood that the invention may be embodied otherwise without departing from such principles.

What is claimed is:

1. An electric power supply operated switch clock for an appliance plug, comprising a housing, constant speed drive motor means in said housing, a plug head mounted in said housing adjacent a back wall thereof and centrally located in said back wall having pin contacts adapted to be engaged in the power supply and being connected to said drive motor means, a plug socket in said housing coaxial with and spaced from said plug head adjacent an opposite front wall of said housing having pin bushings axially aligned with said pin contacts and a socket cup having an opening in said front wall for receiving the appliance plug, a switch ring rotatably mounted in said housing coaxially disposed about said plug socket for timed rotary movement about said plug socket connected to said drive motor means for rotation thereby, a quick-break switch gear in said housing outside said switch ring including at least one pair of switch contacts connected between at least one of said pin contacts and at least one of said pin bushings, said switch ring having an annular shoulder with a plurality of switch rider receiving bores which are angularly equidistantly spaced from each other in said annular shoulder, at least one switch rider in at least one of said receiving bores, said quick-break switch gear having a switching element disposed in the path of movement of said at least one of said switch riders for actuation of movement of said switch rider with said switch ring to make and break contact between said pair of switch contacts, said housing being substantially square in shape with the diameter of said switching ring being slightly smaller than the length of a side of said housing, said drive motor means including a synchronous motor, a timer mechanism having a pinion gear connected between said synchronous motor and said switch ring to rotate said switch ring at a constant timed speed and accommodate it in said housing between said plug head and said plug socket and connected between said plug head and said plug socket, a substantially cylindrical guide body located within said switch ring and connected thereto and extending axially beyond each end thereof with one end portion having a toothed rim engaged with said pinion gear of said timed mechanism and its opposite end portion having an outer grip surface, said housing including a partition wall with a circular rib extending therefrom, said switch ring engaged over and guided for rotation on said rib and said cylindrical guide body engaged around and guided for rotation on said socket cup, said synchronous motor, timing mechanism and quick-break switch gear being disposed around said plug socket in said housing.

2. An electric power supply operated switch clock, according to claim 1, including a cylindrical shell defined within said housing, said synchronous motor located within said shell, said synchronous motor having an armature shaft, said timing mechanism comprising a worm gear on said shaft and reducing gear means connected between said worm and said switch ring.

3. An electric power supply operated switch clock, according to claim 1, wherein said quick-break switch gear includes a two-armed lever having one arm portion extending into the path of motion of a switch rider, and a spring-loaded toggle mechanism connected to said two-armed lever.

4. An electric power supply operated switch clock, according to claim 3, further including a U-shaped bracket connected to said housing adjacent said two-armed lever, an angle lever pivotally mounted in said U-shaped bracket at its one end and including a tongue portion engaged with said two-armed lever, and a toggle lever pivotally mounted in said U-shaped bracket and engaged with said angle lever at an opposite end of said angle lever, said toggle lever including one of said switch contacts, the other of said switch contacts being connected to said housing.

5. An electric power supply operated switch clock, according to claim 1, wherein said housing includes two housing portions which are interengageable, one of which is made of transparent material and provided with an opening in a front wall thereof for receiving said plug socket.

6. An electric power supply operated switch clock, according to claim 5, said housing having an opening exposing said grip surface of said cylindrical guide body for engagement from the exterior of said housing.

7. An electric power supply operated switch clock, according to claim 6, including a time scale defined on said annular shoulder, said housing having a magnifying lens in the front wall thereof for viewing the scale.

8. An electric power supply operated switch clock, according to claim 1, wherein said housing includes two interengageable block-shaped housing parts having a dimension of approximately 70mm on a side thereof.

9. An electric power supply operated switch clock, according to claim 1, wherein said housing includes two substantially blocked-shaped end wall housing portions which are telescopically interengaged, said socket cup engageable into one of said end walls and having a collar portion adjacent one end thereof on the exterior of said socket cup, said cylindrical guide body guided for rotation on said socket cup behind said collar.

10. An electric power supply operated switch clock, according to claim 1, wherein said annular shoulder of said switch ring further includes a second plurality of switch rider receiving bores which are angularly equidistantly spaced from each other in said annular shoulder and each of which is radially aligned with one of said former-mentioned plurality of switch rider receiving bores, said at least one switch rider including a relatively short pin insertable into one of said second and former-mentioned radially aligned switch rider bores and a relatively long pin insertable in the other of said one former mentioned and second switch rider bores, said relatively longer pin extending beyond said annular shoulder and toward said switching element, said switching element comprising a switch wheel including alternately disposed short and long teeth on its periphery, said long pin of said switch rider being selectively positionable in one of said former-mentioned and second radially aligned rider bores to selectively actuate said short and long teeth to rotate said switch wheel.

11. An electric power supply operated switch clock according to claim 10, wherein said switch rider further includes a stud extending upwardly from said long pin to indicate the location of said long pin.

* * * * *